US009990841B2

(12) United States Patent
Moffa

(10) Patent No.: US 9,990,841 B2
(45) **Date of Patent: *Jun. 5, 2018**

(54) TESTING SYSTEM AND METHOD FOR FIRE ALARM SYSTEM

(71) Applicant: Tyco Fire & Security GmbH, Neuhausen am Rheinfall (CH)

(72) Inventor: Anthony P. Moffa, Northborough, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/378,363

(22) Filed: Dec. 14, 2016

(65) Prior Publication Data

US 2017/0092113 A1 Mar. 30, 2017

Related U.S. Application Data

(63) Continuation of application No. 14/157,847, filed on Jan. 17, 2014, now Pat. No. 9,552,720.

(51) Int. Cl.
*G08B 29/00* (2006.01)
*G08B 29/14* (2006.01)
(Continued)

(52) U.S. Cl.
CPC ..... *G08B 29/145* (2013.01); *G08B 25/14* (2013.01); *G08B 29/046* (2013.01); *G08B 29/126* (2013.01); *G08B 17/10* (2013.01)

(58) Field of Classification Search
CPC .... G08B 29/145; G08B 29/14; G08B 29/126; G08B 17/10; G08B 29/046
(Continued)

(56) References Cited

U.S. PATENT DOCUMENTS 4,725,818 A 2/1988 Motyka et al.
6,737,967 B2 5/2004 Farley
(Continued)

FOREIGN PATENT DOCUMENTS

EP 1296301 A2 3/2003
EP 1845497 A2 10/2007
EP 1845499 B1 2/2010

OTHER PUBLICATIONS

"4100U Fire Alarm Panel Operators Guide," Simplex Fire Products. Aug. 4, 2009. Five pages.
(Continued)

*Primary Examiner* — John A Tweel, Jr.
(74) *Attorney, Agent, or Firm* — HoustonHogle LLP

(57) ABSTRACT

A system and method for testing fire detection and fire annunciation devices of a fire alarm system includes a central operations system, which provides a link between a control panel of the fire alarm system and a mobile computing device operated by a technician. During a walk-through test, the on-site technician activates fire detection or fire annunciation devices of the fire alarm system and the activated devices signal the control panel and event data are generated. Event data from the control panel are sent to the central operations system to be stored. The central operations system sends the event data to a mobile computing device operated by the technician. The on-site technician is then able verify that the devices are physically sound, unaltered, working properly, and located in their assigned locations.

28 Claims, 11 Drawing Sheets

(51) Int. Cl.

| | |
|---|---|
| ***G08B 25/14*** | (2006.01) |
| ***G08B 29/12*** | (2006.01) |
| ***G08B 29/04*** | (2006.01) |
| *G08B 17/10* | (2006.01) |

(58) Field of Classification Search
USPC ..... 340/514
See application file for complete search history.

(56) References Cited

U.S. PATENT DOCUMENTS

| | | | | |
|---|---|---|---|---|
| 6,950,016 | B2 | 9/2005 | Farley | |
| 7,167,088 | B2 | 1/2007 | Farley | |
| 7,710,256 | B2 | 5/2010 | Tawil | |
| 7,786,854 | B2 | 8/2010 | Hosey | |
| 8,228,182 | B2 | 7/2012 | Orsini et al. | |
| 8,289,161 | B2 | 10/2012 | Hosey | |
| 8,531,286 | B2 | 9/2013 | Friar et al. | |
| 9,552,720 | B2 * | 1/2017 | Moffa | G08B 29/145 |
| 2003/0058093 | A1 | 3/2003 | Dohi et al. | |
| 2007/0241878 | A1 | 10/2007 | Jobe et al. | |
| 2008/0084291 | A1 | 4/2008 | Campion et al. | |
| 2015/0137968 | A1 | 5/2015 | Rusin et al. | |

OTHER PUBLICATIONS

Partial International Search Report, dated Apr. 23, 2015, from counterpart International Application No. PCT/IB2015/050229, filed on Jan. 12, 2015. Three pages.

International Search Report and Written Opinion of the International Searching Authority, dated Jun. 30, 2015, from counterpart International Application No. PCT/IB2015/050229, filed on Jan. 12, 2015. Twenty-one pages.

International Preliminary Report on Patentability, issued on Jul. 19, 2016, from International Application No. PCT/IB2015/050229, filed on Jan. 12, 2015. Fifteen pages.

* cited by examiner

TESTING SYSTEM AND METHOD FOR FIRE ALARM SYSTEM

RELATED APPLICATIONS

This application is a Continuation of U.S. application Ser. No. 14/157,847, filed on Jan. 17, 2014, which is incorporated herein by reference in its entirety.

BACKGROUND OF THE INVENTION

Fire alarm systems are often installed within buildings such as commercial, residential, or governmental buildings. Examples include hospitals, warehouses, schools, malls and casinos, to list a few examples. These fire alarm systems typically include a control panel and fire detection devices and fire annunciation devices, which are installed throughout the buildings. Some examples of fire detection devices include smoke detectors, carbon monoxide detectors, temperature sensors, and/or pull stations. Some examples of fire annunciation devices include speakers/horns, bells/chimes, light emitting diode (LED) reader boards, and/or flashing lights (e.g., strobes). Additionally, some fire alarm systems may also include security devices such as surveillance cameras, access control readers, and door controllers, to list a few examples.

The fire detection devices monitor the buildings for indicators of fire. Upon detection of an indicator of fire, the device is activated and a signal is sent from the activated device to the fire control panel. Typically, the fire control panel activates audio and visible alarms of the fire annunciation devices of the fire alarm system and sends a signal to a fire department, central receiving station, local monitoring station, and/or other building alarm/notification systems.

Typically, the fire detection and fire annunciation devices are periodically tested (e.g., monthly, quarterly, or annually depending on local interpretation and enforcement of fire protection codes) to verify that the fire detection and fire annunciation devices are physically sound, unaltered, working properly, and located in their assigned locations. This testing of the fire detection and fire annunciation devices is often accomplished with a walkthrough test.

Historically, walkthrough tests were performed by a team of at least two technicians. The first technician walked through the building and manually activated each fire detection and fire annunciation device while the second technician remained at the control panel to verify that the control panel received a signal from the activated device. The technicians would typically communicate via two-way radios or mobile phones to coordinate the testing of each device. In some cases, the technicians might even have resorted to comparing hand written notes of the tested devices. After a group of fire detection and fire annunciation devices was tested, the technician at the panel reset the control panel while the other technician moved to the next fire detection or fire annunciation device.

Recently, single-person walkthrough systems have been proposed. In these systems, the technician connects a computer to the control panel and a first two-way radio. The technician then establishes a communications link with the first two-way radio using a second two-way radio and selecting the same radio frequency on both of the two-way radios. Alternatively, the technician may establish a communications link with cellular phones or a paging transmitter and pager.

During the walkthrough test, the technician places one of the fire detection or fire annunciation devices into an alarm condition. The control panel detects the alarm condition of the activated device and sends a message containing the location and/or address of the activated device to the computer. Next, the computer converts the message received from the control panel to an audio stream and sends the audio stream to the technician over the communications link. The technician hears the location and/or address of the activated device and verifies if the device is wired correctly. The testing process repeats with the next fire detection or fire annunciation device until all of the fire detection and fire annunciation devices of the alarm system have been verified.

SUMMARY OF THE INVENTION

In general, the present system and method are directed to a networked testing system that implements a cloud based infrastructure (e.g., central communications system) to enable communications between a control panel of a fire alarm system and a mobile computing device operated by an on-site technician.

The central communications system provides a link between the control panel of the fire alarm system and the mobile computing device operated by the on-site technician. The central communications system receives event data from the control panel and sends the event data to the mobile computing device in real-time. Illustrated by way of example, upon activation of a fire detection or fire annunciation device, the control panel receives a signal from the activated device. Event data are generated and sent to the central communications system. The event data are stored and/or logged by the central operations system and also sent to the mobile computing device in real-time. The on-site technician is able to view the event data and verify that the fire detection or fire annunciation device is physically sound, unaltered working properly, and in its assigned location. The technician then moves to test the next tire detection or fire annunciation device.

There are additional benefits that may be achieved in embodiments that are built according to the principles of the present invention. For example, one benefit of the present system is that event data are stored by the central operations system. This allows the on-site technician to review all panel activity and historical event data via their mobile computing device (whether manually activated or not). Further, the on-site technician can be made immediately aware of any unsolicited (or "real") alarms if an event is displayed that the on-site technician did not activate. Furthermore, event data are accessible for reviewing and reporting purposes without any additional human intervention (other than activating the fire detection or fire annunciation device to go into alarm).

Additionally, because the event data are stored by the central operations system, if the mobile computing device temporarily loses communications with the central operations system, the mobile computing device is still able to access all of the event data when it gets back into communications range by buffering data by the central operations system.

Still another benefit can be that one or more remote technicians are able to monitor the alarms activated by the on-site technician and the progress of the on-site technician by accessing the event data stored by the central operations system. This enables the remote technician to be able watch for "real" alarms without being on-site with the on-site technician, for example.

It is also possible for two or more on-site technicians, each equipped with their own mobile computing device, to perform testing in parallel. While this does not reduce the manpower used for the walkthrough test, it does reduce the amount of time required to complete the test. Often, this reduced testing time is desirable in buildings where interruption and disruptions are undesirable (e.g., hospitals).

Another potential benefit of the present system is that the central operations system can record the unique device address of the activated device along with the activation, acknowledgement and restoral times detected by the control panel. While the fire detection or fire annunciation devices are manually activated by the on-site technician, the recorded event data are generated by the control panel. This ensures that test data cannot be manually entered, altered, or falsified.

In embodiments, smoke detectors, which require occasional cleaning, can be identified during the walkthrough test. Typically, an analog value is included as part of the event data on the mobile computing device. This analog value can be used to indicate that the device needs to be serviced or cleaned. Thus, these devices do not need to be reviewed separately or revisited as part of a cleaning cycle.

Yet another potential benefit is that the configuration is automated. For example, system startup of the testing computer automatically invokes the agent software of the testing computer, in one example. The agent software can automatically query the control panel for its operating parameters (such as e.g., device name, model number, serial number, software revision, and configuration) and automatically create a unique identifier for the control panel. The agent software then securely communicates the operating parameter information to the central operations system. Moreover, if the control panel is new to the system, the central operations system creates a new entry in the data storage system. If the control panel already exists in the records of the data storage system, the central operations system appends information to the existing record.

In general, according to one aspect, the invention features a method for testing a fire alarm system. The method includes a technician activating devices of the fire alarm system. The activated devices signal a control panel and event data from the control panel are sent to a central operations system. The method further includes sending the event data from the central operations system to a mobile computing device operated by the technician.

In embodiments, the central operations system receives event data from different control panels in response to testing different fire alarm systems at different facilities and in this way functions as a cloud-based system that handles information from many different customers and/or independent business entities. The received event data from the different control panels of different fire alarms systems are stored in a single data storage system of the central operations system.

Preferably, the central operations system sends device history data along with the event data to the mobile computing device operated by the technician. In response to a failed transmission of the event data to the mobile computing device, the central operations system buffers and then later resends the event data to the mobile computing device to deal with temporary communications link failure caused by loss of a wireless or cellular signal.

In examples, the technician can apply annotations to the received event data, the annotated event data being sent to the central operations system. Generally, the event data includes a physical address of the activated devices, a date and time of the activation, a fault state of the activated devices, the current analog value of the activated devices (if applicable), and/or a custom label/descriptor of the activated devices.

To facilitate connection to the proper control panel by the mobile computing device, coordinates of the mobile computing device are derived using cellular triangulation. Alternatively, a location can be determined with a reverse lookup using geographic information system (GIS) coordinates.

In more detail, after choosing the map application on the mobile computing device, the on-site technician is shown their current location and the location of panels in the specific area. Typically, filters or toolbars are provided to reduce the map view down to a local radius such as 1 mile or to expand the radius to 20 miles (or more). The panel location position is triangulated when using a temporary (or On Demand) cellular connection and then sent to the central operations system.

Alternatively, or in cases where a permanent connection (e.g., enterprise network) is in place, the panel address in the data storage system is used for a reverse lookup to produce the GIS coordinates, which provide a location of the mobile computing device.

Alternately, or in addition, a panel identifier (e.g., serial number) can be sent to the central operations system, the central operations system identifying a specific control panel and returning information of the identified control panel to the mobile computing device to enable the technician to verify the control panel associated with the panel identifier.

Typically, the devices include smoke detectors, carbon monoxide detectors, temperature sensors, annunciators, pull stations, speakers/horns, bell/chimes, light emitting diode (LED) reader boards, and/or strobes. Additionally, in future embodiments, the fire detection and fire annunciation devices could also include addressable sprinkler heads or addressable foam generator heads.

In one example, in response to receiving unsolicited device activations at the control panel, event data of the unsolicited device activations are sent to the central operations system and the central operations system sends the event data of the unsolicited device activations to the mobile computing device to warn the technician about possible emergencies.

In the preferred embodiment, the central operations system sends an aggregate history of all the devices of the fire alarm system to the mobile computing device in response to a report request from the mobile computing device.

In general, according to another aspect, the invention features a testing system for a fire alarm system comprising a control panel that receives signals from devices, including signals generated in response to activation of the devices by a technician during a test of the devices, and that generates event data based on the signals. The testing system includes a central operations system that receives the event data. The testing system further including a mobile computing device that is operated by the technician that receives the event data from the central operations system.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms of the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1A:
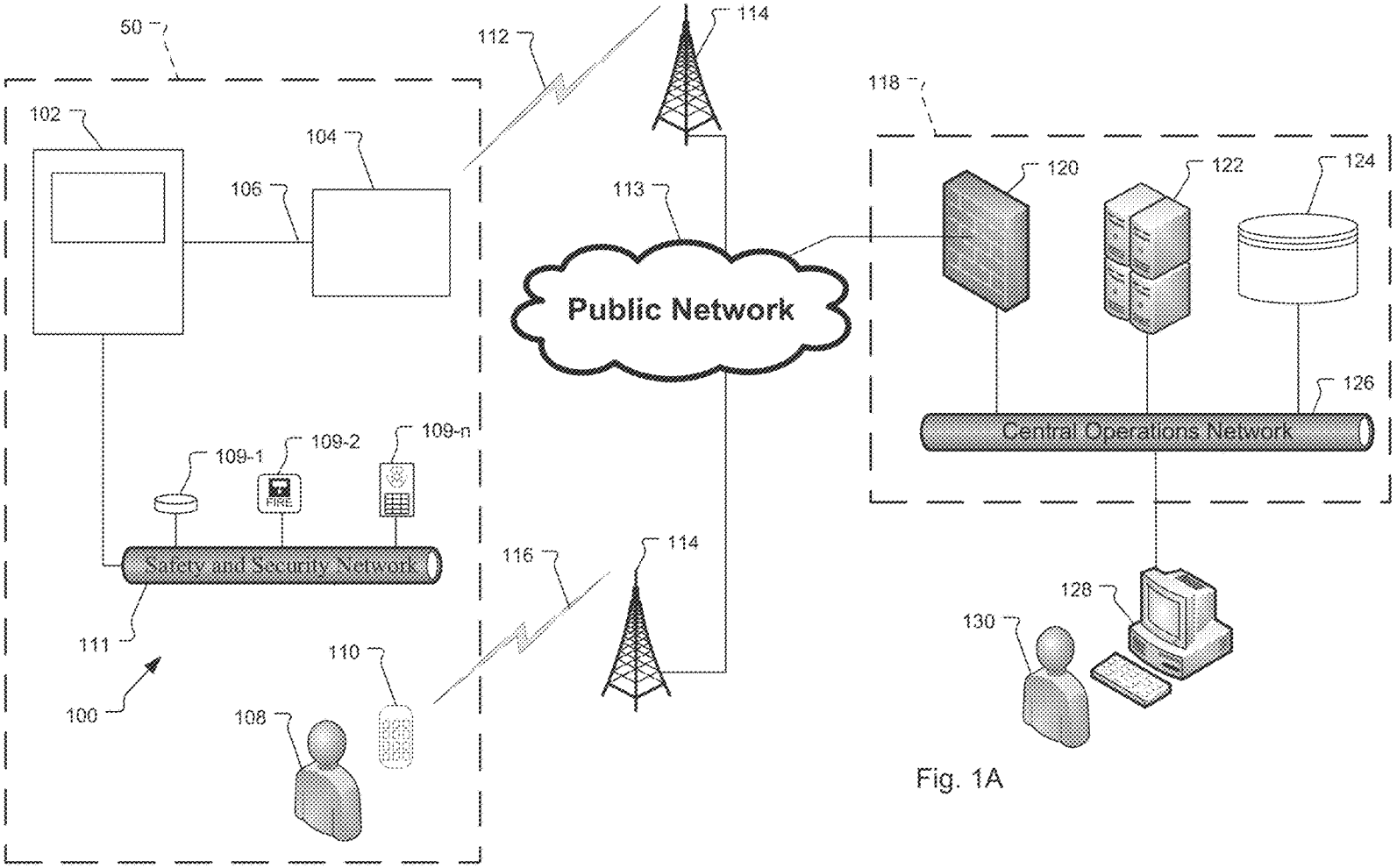
FIG. 1A is block diagram illustrating the relationship between a fire alarm system, a testing computer, a central operations system, and a mobile computing device.

FIG. 1A is block diagram illustrating the relationship between a fire alarm system 100, a facilities testing computer 104, a central operations system 118, and a mobile computing device 110 operated by the on-site technician 108.

In a typical implementation, the fire alarm system 100 is located within a building 50. The building could be residential, commercial or governmental. Examples include a hospital, warehouse, retail establishment, mall, school, or casino, to list a few examples.

In the illustrated example, the fire alarm system 100 includes a fire control panel (control panel) 102 and fire detection and fire annunciation devices 109-1 to **109-*n*. The fire detection devices typically include smoke detectors, carbon monoxide detectors, temperature sensors, and/or pull stations, to list a few examples. Similarly, examples of the fire annunciation devices generally include speakers/horns, bells/chimes, light emitting diode (LED) reader boards and/or flashing lights (e.g., strobes). The fire detection and fire annunciation devices 109-1 to 109-*n* and control panel 102 are connected to a safety and security wired and/or wireless network 111 of the building 50, which supports data and/or analog communication between the devices 109-1 to 109-*n* and the control panel 102**.

Additionally, in some embodiments, the fire alarm system 100 further includes security devices such as security cameras, door controllers, access control readers, or motion sensors. These security devices may or may not be tested during a walkthrough test.

While not shown in the illustrated example, the fire alarm system and the safety and security network are often divided into different zones. For example, each floor in an office building may be a separate zone of the system. These separate zones may be controlled with separate control panels and/or subpanels.

Returning to the illustrated example, a facilities testing computer (testing computer) 104 is connected to the control panel 102. In a current implementation, the testing computer 104 is connected to the control panel 102 with an RS-232 cable 106. Alternative embodiments, however, may utilize other cables such as a universal serial bus (USB) cable or Ethernet (IEEE 802.3) cable (e.g., Cat 5 or Cat 6), to list a few examples. Other embodiments of this connection may include wireless connections such as sub-Giga Hertz serial, Bluetooth or ZigBee, to list a few examples.

The testing computer 104 connects to a public network 113 (e.g., the Internet) over possibly a wireless communication link 112. In a current implementation, the wireless communication link 112 is encrypted using standard SSL (Secure Sockets Layer encryption methods with the option for additional encryption such as Advanced Encryption Standard (AES), in specific implementations. The data are routed through one or more cellular radio towers (e.g., reference numeral 114) of a mobile broadband or cellular network. Typically, the radio tower uses GPRS (General Packet Radio Service), GSM (Global System for Mobile Communications), or a CDMA (Code Division Multiple Access) technology. In an alternative embodiment, the testing computer 104 may connect to the public network 113 via public and/or private wired data networks such as an enterprise network or Wi-Max or Wi-Fi network, for example.

The mobile computing device 110 is connected to the public network 113 over a wireless communication link 116 and operated by the on-site technician 108. Similar to the testing computer 104, the data on the public network 113 and en route to the mobile computing device 110 via the wireless communications link 116, is preferably encrypted using SSL encryption. In a current embodiment, the mobile computing device 110 is a laptop computer, smart phone, tablet computer, or phablet computer (i.e., a mobile device that is typically larger than a smart phone, but smaller than a tablet), to list a few examples. In an alternative embodiment, the mobile computing device 110 may also connect to the public network 113 via public and/or private data networks.

While the illustrated example only shows a single on-site technician 108, it is possible for two or more on-site technicians, each equipped with their own mobile computing device, to perform testing in parallel. While this does not reduce the manpower or costs needed to complete the walkthrough test, it can reduce the amount of time needed to complete the test, which may desirable in buildings where disruptions are undesirable (e.g., hospitals).

The central operations system 118 preferably includes a central operation system firewall 120, an applications server 122, and a data storage system 124.

The central operation system firewall 120 is a software or hardware network security feature which filters incoming and outgoing network traffic to increase security for the central operations network 126. The applications server 122 acts as the repository and portal to access event data generated by the control panel 102 and sent by the facilities testing computer 104. While the fire detection or fire annunciation devices are manually activated by the on-site technician during the walkthrough test, all event data are generated by the control panel 102. This ensures that test data cannot be manually entered, altered, or falsified.

Typically, the event data include the unique identifier for the fire alarm control panel 102, a physical address of the activated devices (109-1, 109-2 . . . **109-*n***), a date and time of the activation, a fault state of the activated devices, at least one analog and/or detected value by the activated devices such as a detected smoke level or detected ambient temperature, and/or custom labels of the activated devices. Additionally, acknowledgement and restoral times of the control panel are included in the event data.

In a current implementation, the analog and/or detected value is included as part of the event data on the mobile computing device to indicate that a device needs to be serviced or cleaned. This enables devices that require occasional cleaning to be identified during the walkthrough test.

The central operation system firewall applications server 122, and data storage system 124 are connected via a central operations network 126. The central operation network 126 is a data network such as an enterprise network, for example.

The illustrated embodiment further includes a remote technician 130. This technician 130 is able to access the central operations system 118 with a remote workstation 128. This remote technician 130 may support and/or monitor the progress of the on-site technician 108. In an alternative embodiment, this remote workstation 128 is securely connected to the central operations network 126 using the public network 113. Connectivity to the public network 113 is achieved in a variety of ways including, for example, cellular data networks, private and/or public hardwired or wireless networks as well as other options known in the art. The remote workstation 128 is typically a computing device such as a desk top PC, laptop, tablet, phablet or smart phone, to list a few examples.

Figure 1B:
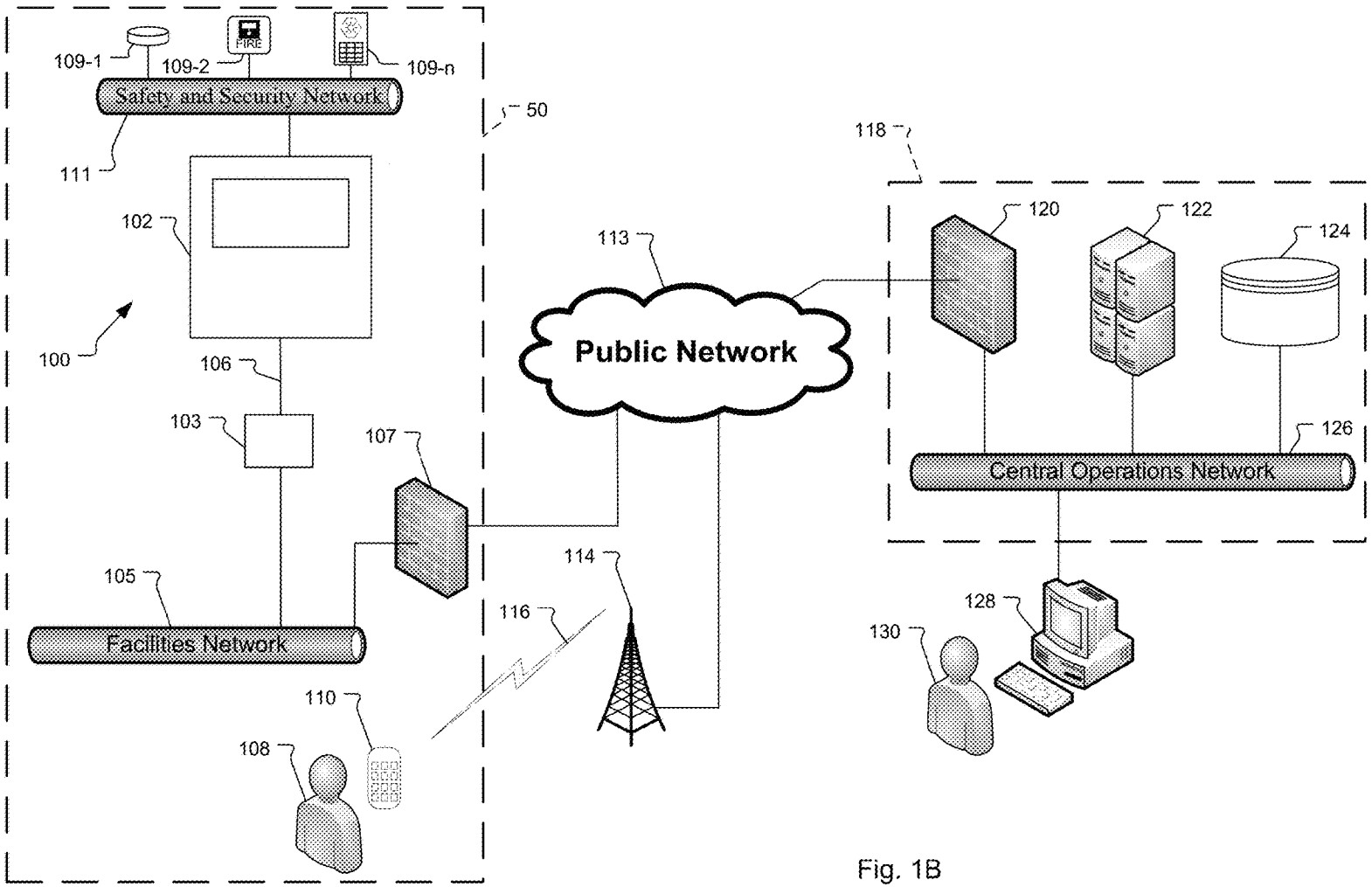
FIG. 1B is block diagram illustrating an alternative embodiment.

FIG. 1B is block diagram illustrating an alternative embodiment of the relationship between the fire alarm system 100, the testing computer 104, the central operations system 118, and the mobile computing device 110.

FIG. 1B is nearly identical to FIG. 1A. In this embodiment, however, the testing computer 104, radio tower 114, and the wireless communication link 112 are removed. In this embodiment, a serial to Ethernet converter 103 connects to the control panel 102 a facilities network 105 of the building 50. The serial to Ethernet converter 103 is similar to the testing computer 104, but it provides a wired connection to connect to the public network 113 and central operations system 118.

In the illustrated embodiment, the facilities network 105 includes a facilities firewall 107 between the facilities network 105 and the public network 113. The facilities firewall 107 filters incoming and outgoing network traffic of the facilities network 105.

In a typical implementation, secure communications leave the serial to Ethernet converter 103, traverse the facilities network 105, and pass through the facilities firewall 107 using conventional encryption methodologies and ports and does not require firewall modifications in order to operate effectively.

Figure 2:
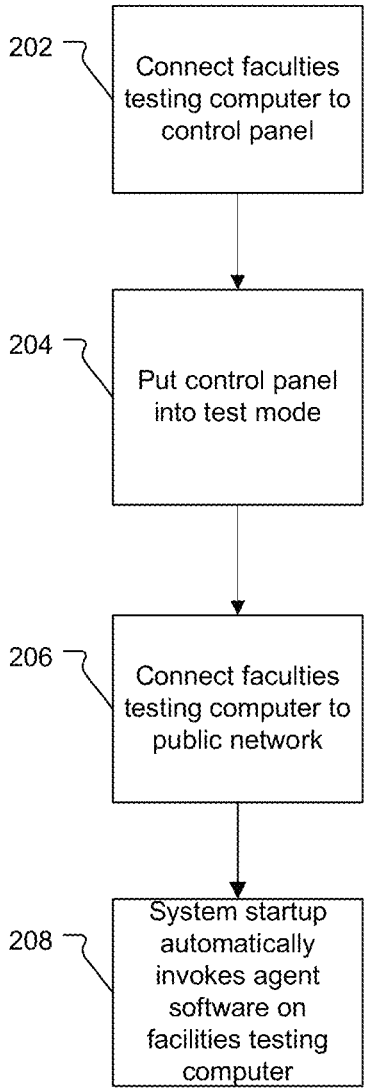
FIG. 2 is a flowchart illustrating the installation and setup of a facilities testing computer at the fire control panel of the fire alarm system.

FIG. 2 is a flowchart illustrating the installation and setup of the testing computer 104 at the fire control panel 102.

In the first step 202, the on-site technician 108 connects the testing computer 104 to the control panel 102 via the connection 106. Next, in step 204, the on-site technician 108 puts the control panel 102 into test mode. This step ensures that the on-site technician 108 is at the building 50 and involved with the testing. Generally, this step is related to code compliance. It ensures the technician is on site and enables access to the auto acknowledgement features of the agent software.

Generally, test mode silences and/or deactivates audio and visual alarms/warnings of the fire annunciation devices during the walkthrough test. Generally, the fire detection devices are still able to detect indicators of fire, but audio and visual warnings of the fire annunciation devices are silenced if the fire detection device is activated. Additionally, if the fire detection devices have built in audio or visual alarms, these alarms are also typically silenced/deactivated in test mode. This allows the fire detection devices to continue detecting fires, but prevents the intentionally activated devices from disrupting occupants of the building during the walkthrough test.

Next, the on-site technician 108 connects the testing computer 104 to the public network 113 in step 206. In the next step 208, system startup of the testing computer 104 automatically invokes the agent software of the testing computer 104.

Figure 3:
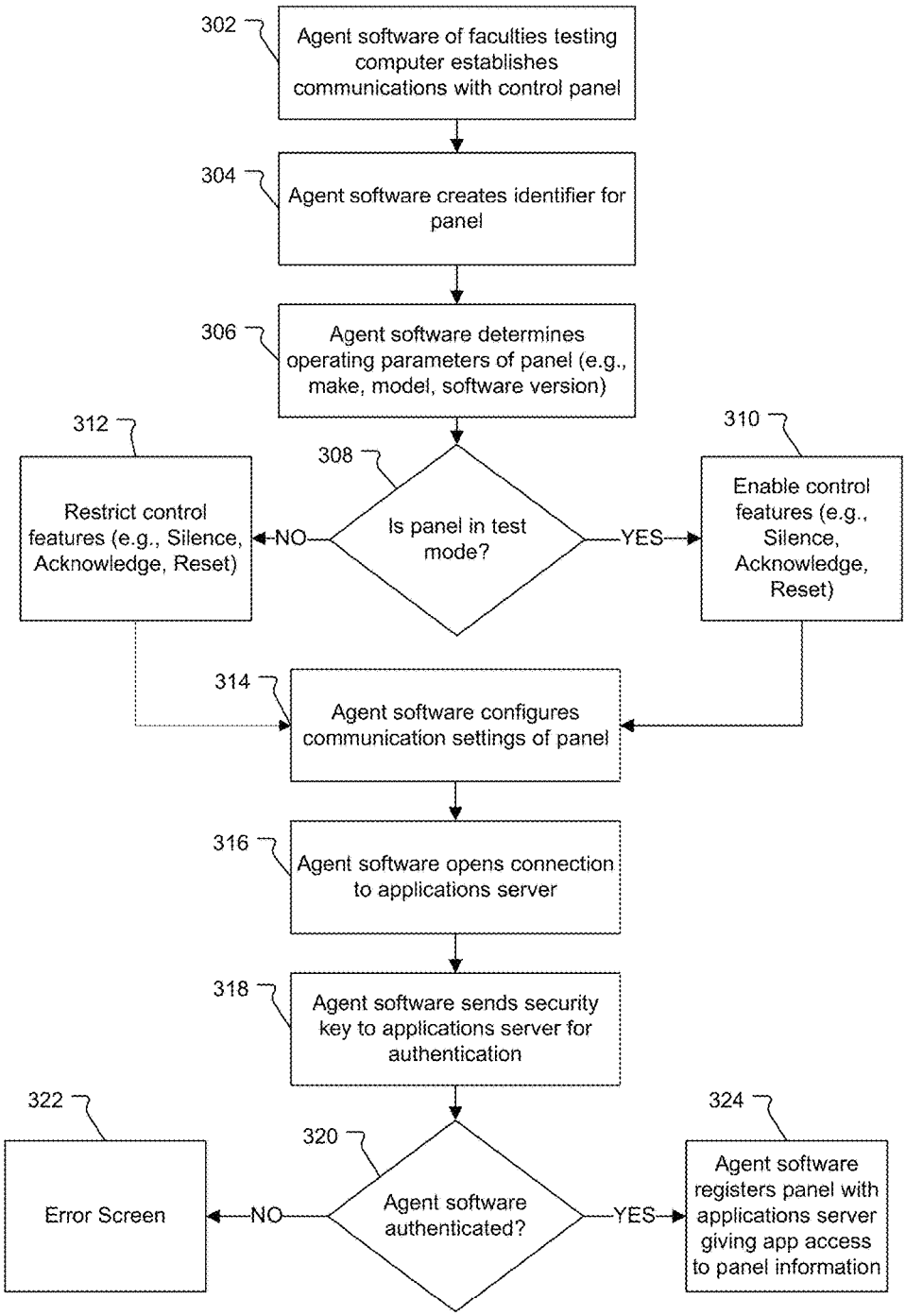
FIG. 3 is a flowchart illustrating the initialization of agent software of the facilities testing computer.

FIG. 3 is a flowchart illustrating the initialization of the agent software of the testing computer 104.

The agent software of the testing computer 104 establishes communication with the control panel 102 of the fire alarm system 100 in step 302. Next, the agent software creates or accesses a unique identifier for the control panel 102 in step 304. In the next step 306, the agent software determines operating parameters (e.g., device name, model number, serial number, software revision, and configuration) of the control panel 102.

The agent software then determines if the control panel 102 is in test mode in step 308. If the control panel 102 is in test mode, then control features (e.g., silence, acknowledge, and reset) are enabled in step 310. If the control panel 102 is not in test mode, then those control features are restricted in step 312.

The agent software then configures the communications settings of the control panel 102 in step 314. Next, in step 316, the agent software opens a connection to the applications server 122 through the firewall 120. The agent software sends a security key for authentication in step 318.

If the security key is authenticated in step 320, then the agent software registers the control panel 102 with the applications server 122 to enable an application (app) executing on the mobile computing device 110 to access information from the control panel in step 324. Alternatively, if the security key is not authenticated in step 320, then an error screen is displayed in step 322.

Figure 4:
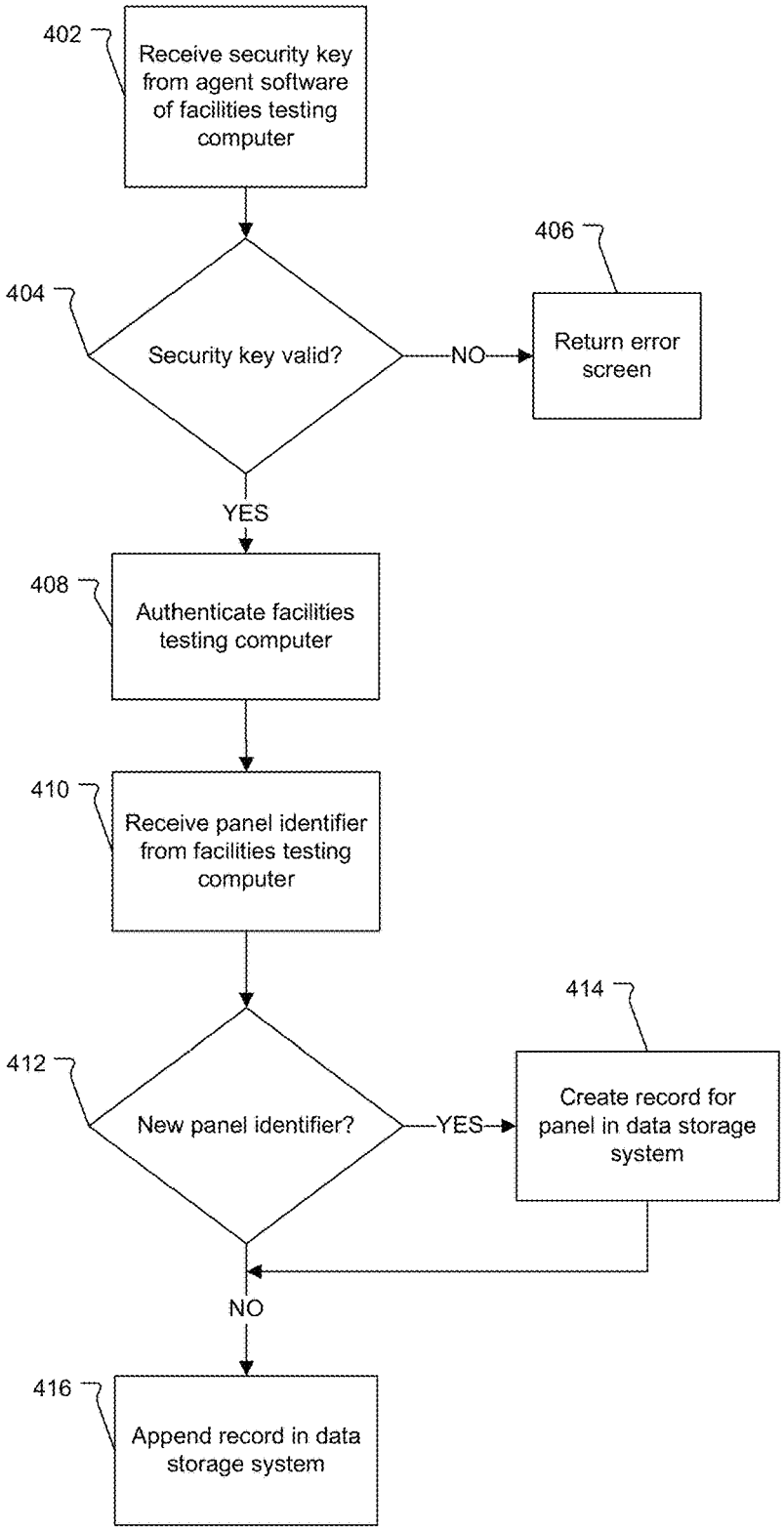
FIG. 4 is a flowchart illustrating the authentication of the agent software of the testing computer.

FIG. 4 is a flowchart illustrating the authentication of the agent software of the testing computer 104 and the appending of records of the data storage system 124 of the central operations system 118.

In the first step 402, the applications server 122 of the central operations system 118 receives the security key from the agent software of the testing computer 104. The applications server 122 determines if the security key is valid in step 404. If the security key is not valid, then the applications server 122 returns an error screen in step 406. If the security key is valid, then the applications server 122 authenticates the testing computer 104 in step 408.

After authenticating the testing computer, the applications server 122 receives the unique panel identifier (i.e., the panel identifier created or accessed in step 304 of FIG. 3) from the testing computer 104 in step 410. In the next step 412, the applications server 122 determines if the panel identifier is new. That is, the applications server 122 determines whether records already exist in the data storage system 124 of the central operations system 118.

If the panel identifier is new, then the applications server 122 creates a new record for the control panel in the data storage system 124 in step 414. The applications server 124 then appends the record in the data storage system 124 in step 416. Alternatively, if the panel identifier is not new, then the applications server 122 appends the existing record in the data storage system 124 in step 416.

Figure 5A:
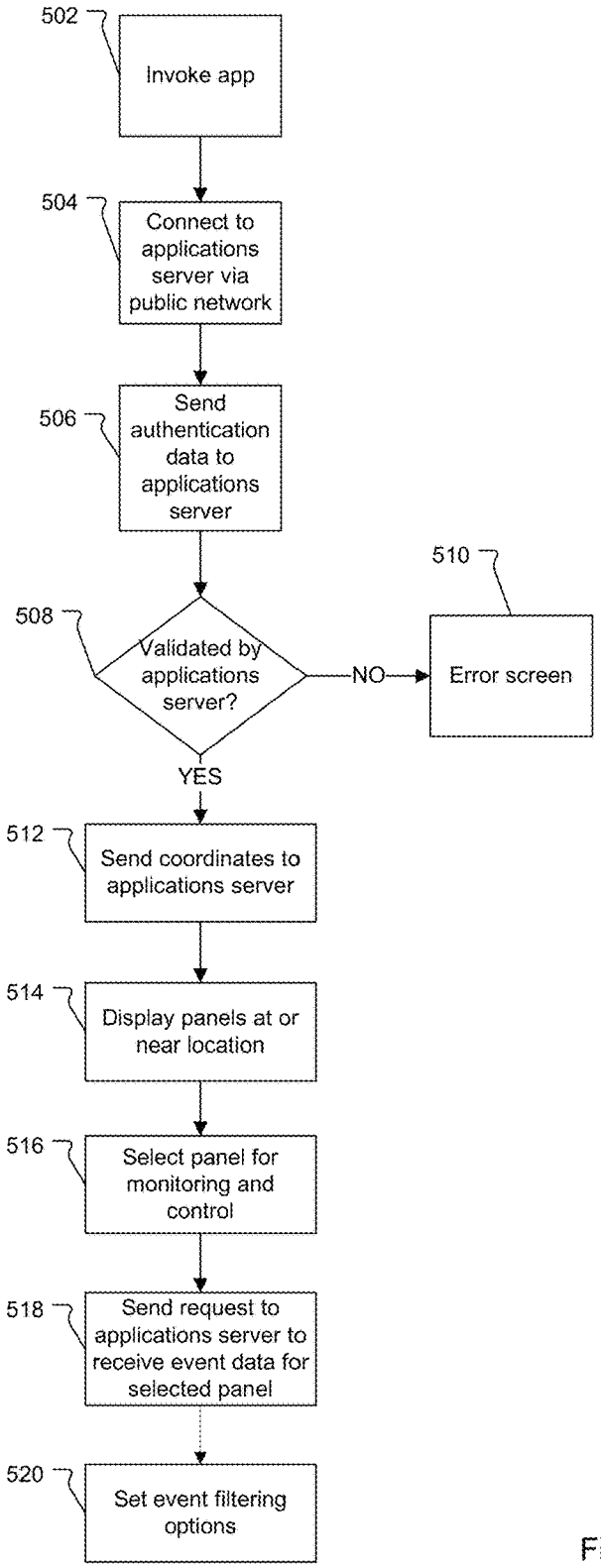
FIG. 5A is a flowchart showing an initialization of an application (app), which is invoked on a mobile computing device of a technician.

FIG. 5A is a flowchart showing the initialization of the application (app), which is invoked by the on-site technician 108 operating the mobile computing device 110.

In a first step 502, the on-site technician 108 invokes the app on the mobile computing device 110. The app connects the mobile computing device 110 to the applications server 122 and sends authentication data to the applications server 122 in steps 504 and 506, respectively.

If the authentication data are not validated b r the applications server 122 in step 508, then an error screen is displayed in step 510, if, however, the authentication data are validated by the applications server 122, then coordinates of the mobile computing device are sent to the applications server 122 in step 512. In a current implementation, the coordinates are positioning information obtained from a GPS receiver of the mobile computing device 110.

In another embodiment, the coordinates are derived from mobile phone location tracking data. For example, location can be derived by cellular triangulation using a temporary (or On Demand) cellular connection.

In yet another alternative embodiment, a location can be determined via a reverse lookup using the control panel address in the data storage system can produce geographic information system (GIS) coordinates.

After sending the coordinates to the applications server 122, the applications server sends a list of panels to the mobile computing device 110 which displays the control panels that are at (or near) the location of the coordinates in step 514. In examples, the control panels are displayed as a selectable list. In other examples, the control panels are displayed in a map view (see FIG. 5B). The on-site technician 108 then preferably selects a control panel from those in the list or in the map view for monitoring and control in step 516. Next, in step 518, the mobile computing device 110 sends a request to the applications server 122 to receive event data for the selected control panel.

The on-site technician is also able to set event filtering options in step 520. The event filtering options allow to the on-site technician 108 to filter out unwanted event data. Additionally, the on-site technician 108 may select how event data are presented on the mobile computing device 110. For example, the event data are presented chronologically, segregated by zones of the fire alarm system, and/or based on which fire detection or fire annunciation devices have been activated the most/least, to list a few examples, based on technician control.

Figure 5B:
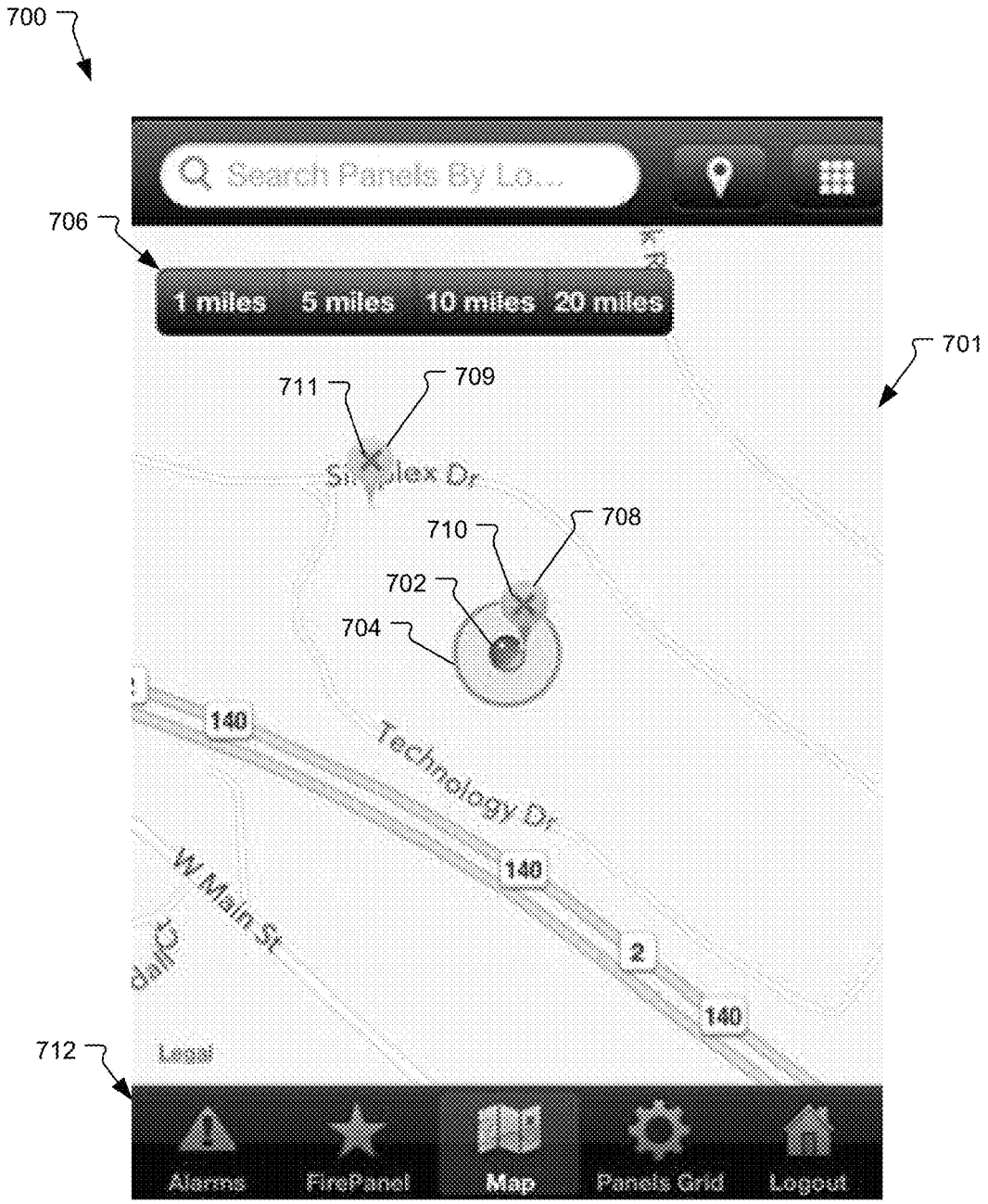
FIG. 5B is an example of a user interface displayed on the mobile computing device that shows nearby control panels based on the coordinates of the mobile computing device.

FIG. 5B is an example of a user interface 700 of the application (app), which is displayed on the mobile computing device 110. The user interface 700 displays a map view including nearby control panels based on the coordinates of the mobile computing device 110.

In a typical implementation, the location of the mobile computing device is shown on a map 701 as a point 702. Additionally, a position error associated with the location of the mobile computing device is shown as a ring 704.

The app provides a range toolbar (or filter) 706 that enables the on-site technician 108 to set a radius to select an area of interest. Any control panels within the selected area of interest are displayed on the map using push pins (e.g., reference numerals 708 and 709). In the illustrated embodiment, the range toolbar 706 allows the on-site technician 108 to choose an area of interest of 1 mile, 5 miles, 10 miles, or 20 miles. Alternatively, in other embodiments, a user-entered area of interest could be implemented.

In a current embodiment, the push pins are color-coded to provide additional information about the status of the control panels. For example, a green push pin indicates that the control panel is operating properly. A yellow push pin indicates that the control panel has maintenance issues. Lastly, a red pushpin indicates afire has been detected by one of the fire detection devices connected to the control panel.

Additionally, the current implementation also displays an 'X' (e.g., reference numerals 710, 711) within the push pins to indicate that the software agent has stopped communicating with the central operations system 118. This provides real-time feedback to the on-site technician 108 that there is a problem with the connection to the central operations system 118 that may need to be resolved before testing can begin (or continue).

A setting toolbar 712 of the user interface 700 enables the on-site technician 108 to view activated alarms, view fire panel information, or display the map view, shows a panels grid, or logout of the app.

Figure 5C:
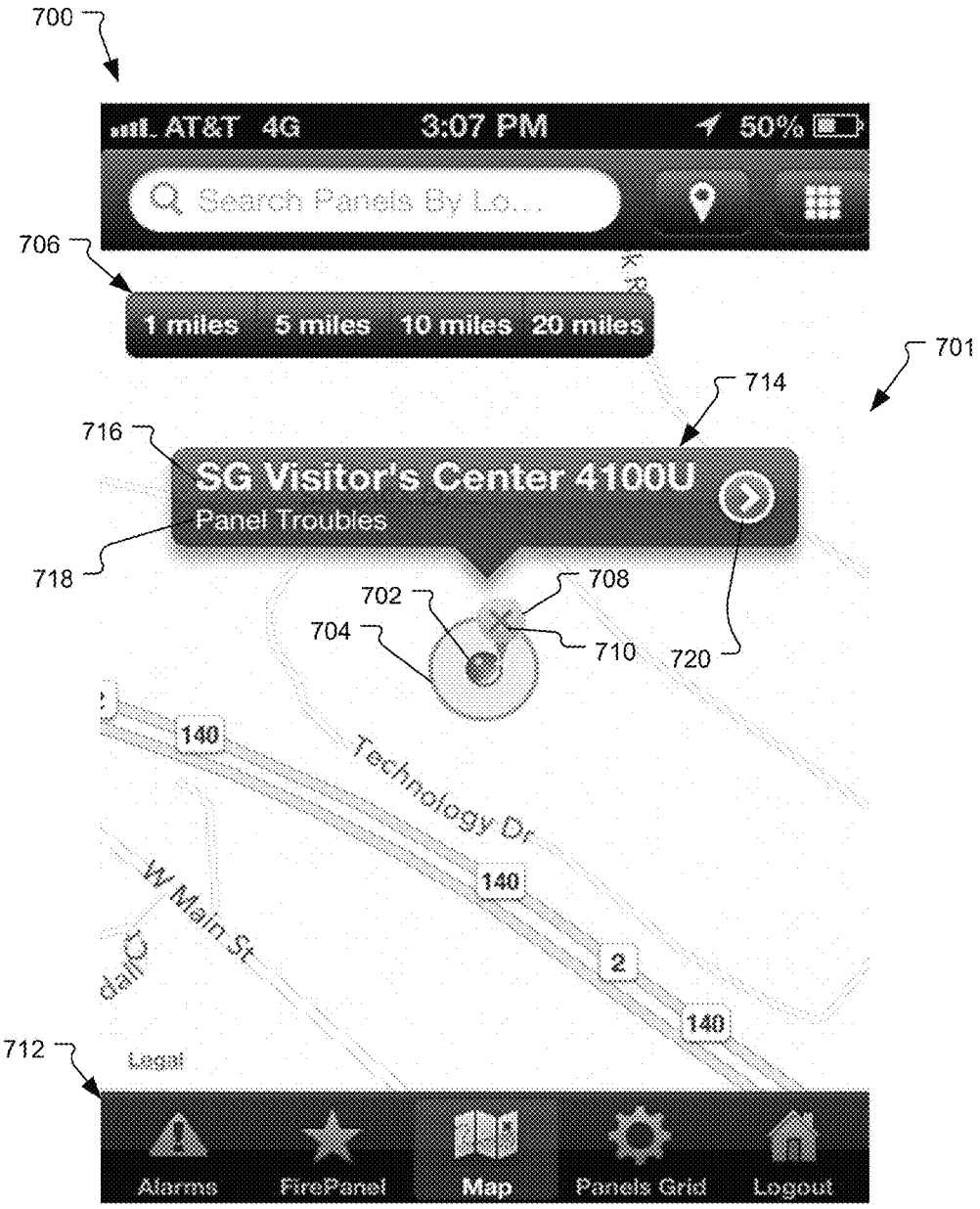
FIG. 5C illustrates an example of how the on-site technician is able to interact with the user interface and view additional information of the control panel on the mobile computing device.

FIG. 5C illustrates an example of how the on-site technician 108 is able to interact with the user interface 701 and view additional information of the control panel 102 on their mobile computing device 110.

In the illustrated example, the on-site technician 108 touches the push pin 708 to get information about the control panel 102. Touching the push pin 708 produces an on screen title bar 714 that includes the panel name 716, status 718, and a carat icon 720. Selecting the carat icon 720 connects the mobile computing device 110 to the control panel details portion of the application, which enables the on-site technician 108 to view hardware configuration, software configuration, current status, historical data, and real-time event information of the control panel.

Figure 6A:
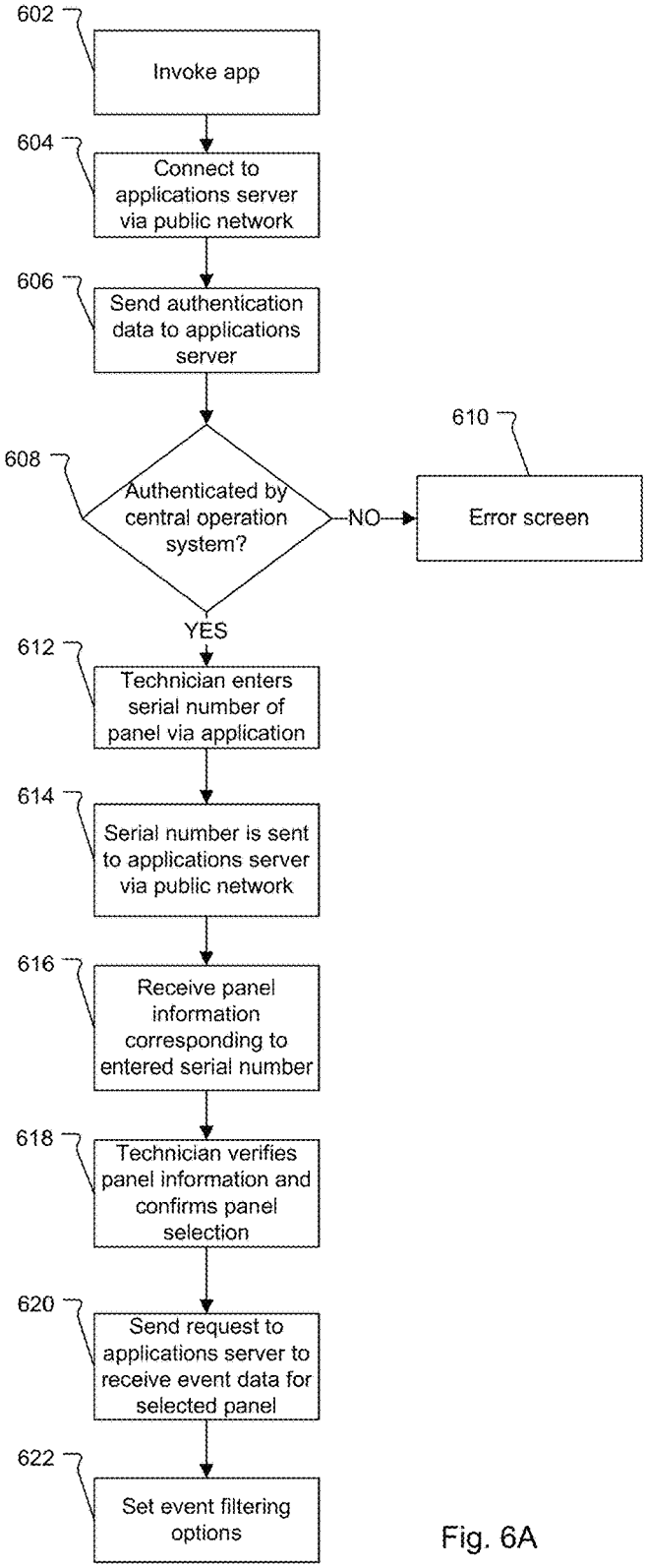
FIG. 6A is an alternative embodiment of the initialization of the app, which is invoked on the mobile computing device of the on-site technician.

FIG. 6A is an alternative embodiment of the initialization of the application (app). In this alternative embodiment, the on-site technician 108 uses a panel serial number to select the control panel rather than coordinates of the mobile computing device 110.

In the illustrated flowchart, steps 602 through 610 are identical to steps 502 through 510 of FIG. 5A.

In this illustrated embodiment, the control panel 102 is not determined (and selected) based on coordinates obtained from the mobile computing device 110. Instead, the on-site technician 108 enters all (or part) of a panel serial number via the app in step 612.

The serial number is sent to the applications server 122 of the central operation system 118 via the public network 113 in step 614. Next, in step 616, the mobile computing device 110 receives panel information (e.g., device name, device model, location, and customer ID associated with panel) that corresponds to the entered serial number, which information has been sent by the applications server 122. The on-site technician 108 verifies that the received panel information matches the control panel and confirms the control panel selection in step 618.

In the next step 620, the app sends a request to the applications server 122 of the central operation system 118 to receive event data for the selected control panel. Similar to the embodiment described with respect to FIG. 5, the on-site technician is then able to set event filtering options in step 622.

Figure 6B:
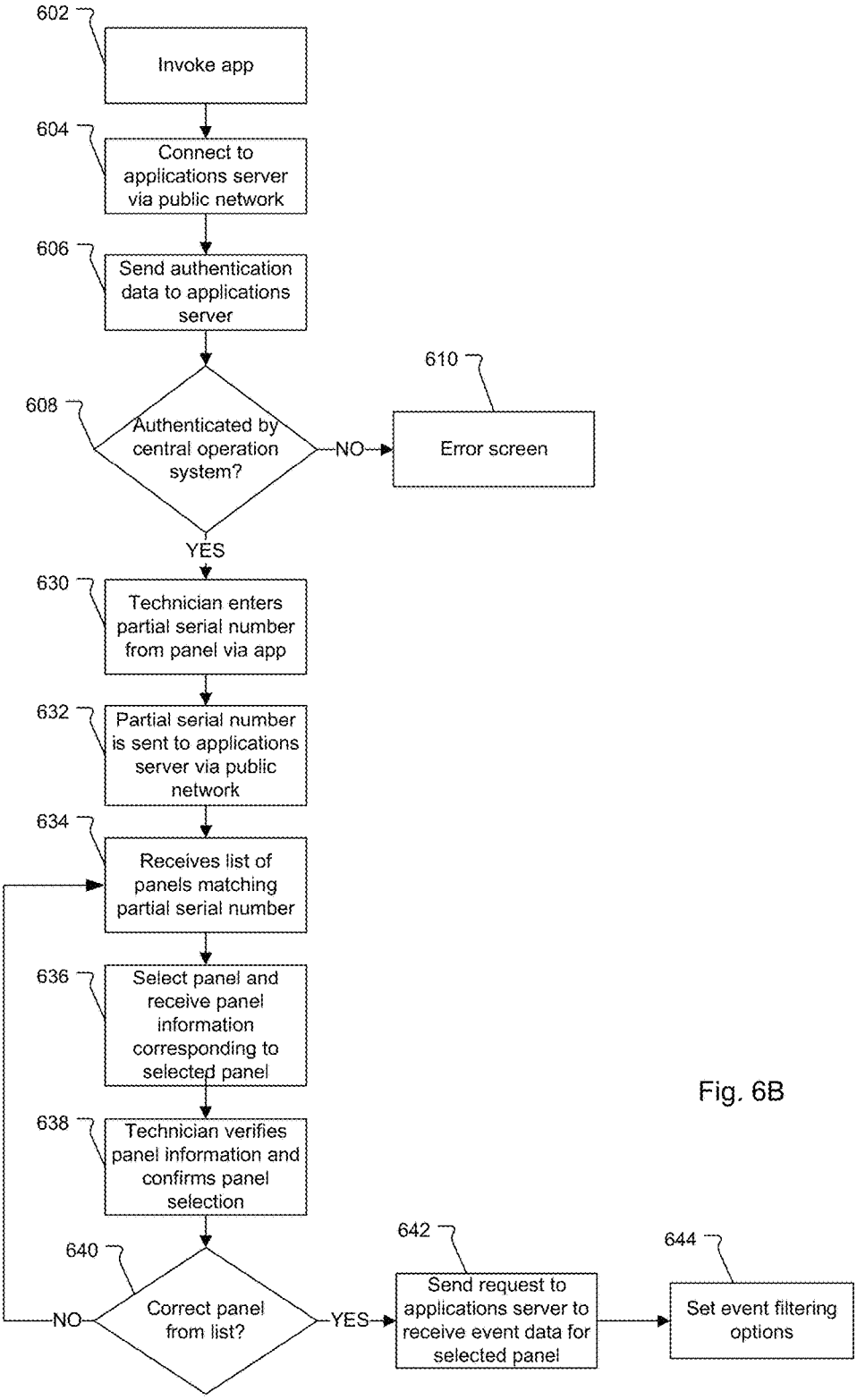
FIG. 6B an alternative embodiment of the initialization of the app, in which the on-site technician is able to search for control panels by entering a partial serial number of the control panel.

FIG. 6B illustrates an example in which the on-site technician 108 is able to search for control panels by entering a partial serial number of the control panel 102.

In the illustrated example, steps 602 through 610 are identical to steps 60 through 610 in FIG. 6A. After completing steps 602 through 610, the on-site technician 108 enters a partial serial number of the control panel via app in step 630 to search for control panels.

Next, the partial serial number is sent to the central operations system 118 via the public network 113 as described in step 632. In step 634, the mobile computing device 110 receives a list of control panels matching the partial serial number. Typically, the list of control panels includes more than one control panel. Accordingly, the more digits of the serial number that are entered by the on-site technician 108, the shorter the received list will be (in step 634).

The on-site technician 108 then selects a control panel from the received list and receives specific panel information that corresponds to the selected panel in step 636. The on-site technician 108 verifies the details of the panel presented on their mobile computing device 110 in step 638.

In the next step 640, the on-site technician 108 determines if the selected panel is the correct control panel. In the case of a correct control panel, in step 642, the app sends a request to the applications server 122 of the central operation system 118 to receive event data for the selected control panel. Similar to the embodiments described with respect to FIGS. 5 and 6A, the on-site technician 108 is then able to set event filtering options in step 644.

In the case of an incorrect panel, the on-site technician 108 returns to step 634 and selects another panel to review. Additionally, while not shown in the illustrated example, the on-site technician 108 may return previous steps (e.g., to step 630) to enter a full panel serial number.

Figure 7:
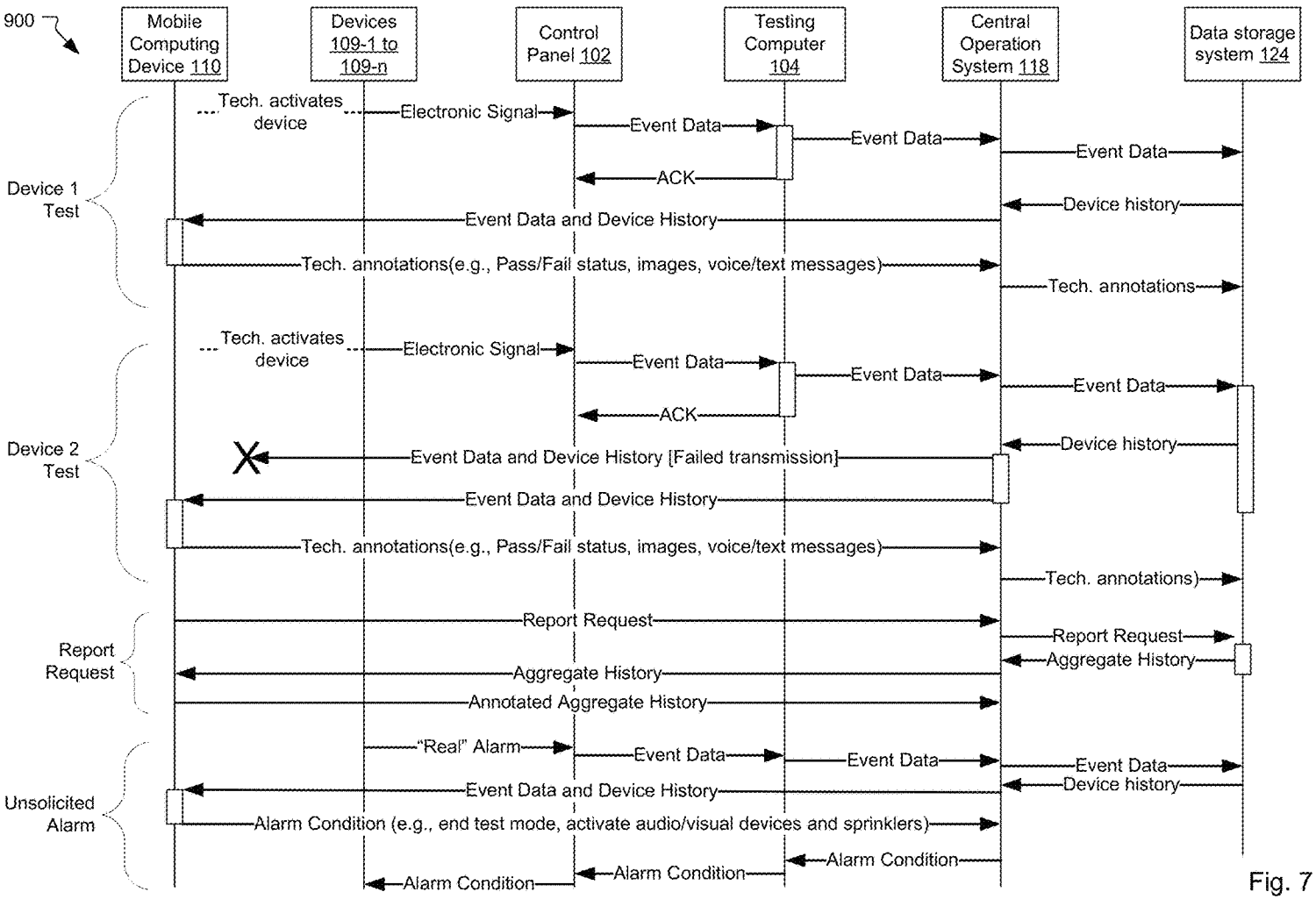
FIG. 7 is a sequence diagram illustrating how the mobile computing device, fire detection and fire annunciation devices, control panel, testing computer, central operations system, and data storage system interact during the test.

FIG. 7 is a sequence diagram 900 illustrating how the mobile computing device 108, fire detection and fire annunciation devices 109-1 to **109-*n*, control panel 102, testing computer 104, central operations system 118 (applications server 122), and data storage system 124** interact during the test.

In a first example (labeled Device 1 Test), the on-site technician 108 activates one of the fire detection and fire annunciation devices 109-1 to **109-*n* of the fire alarm system 100. The activated device sends an electronic signal to the control panel 102. The control panel generates event data, which are sent to the testing computer 104. If the control panel 102 has the acknowledgement (ACK) feature enabled, then the testing computer 104 provides an immediate ACK, to the control panel 102 to silence the local and remote sounders connected to the control panel 102. The event data are then sent from the testing computer 104 to the applications server 122 of the central operations system 118, which stores the event data in the data storage system 124. The central operations system 118 then sends the event data and device history data to the mobile computing device 110**.

In the illustrated example, the on-site technician 108 reviews the event data and optionally applies annotations to the event data. These annotations typically include a pass or fail status, images, and/or voice and text messages, to list a few examples. For example, if the fire detection or fire annunciation device appears worn or damaged, the technician would annotate the event data with an image of the device. The annotated event data are then sent back to the central operations system 118 and stored in the data storage system 124. This annotated device history may be accessed later by the on-site technician 108, a remote technician 130, or other users that are authorized to access the event data.

A second example (labeled Device 2 Test) illustrates a scenario in which the mobile computing device 110 temporarily loses communication with the central operations system 118. In general, the testing process is similar to the previous example (i.e., Device Test 1). In this example, however, the mobile computing device 110 temporarily loses communication with the central operations system 118. Because communication has been lost, the transmission of event data from central operations system 118 fails to reach the mobile computing device 110. In the illustrated example, this is shown by the "X." In a current implementation, if there is a failed transmission, the central operations system 118 buffers and attempts to resend the event data. This event data could be resent based on a request from the mobile computing device 110 or the central operations system 118 could attempt resend the event periodically until event data are received and acknowledged by the mobile computing device 110.

The sequence diagram 900 further illustrates a report request from the on-site technician (labeled Report Request). Typically, reports are generated after the on-site technician 108 has completed the test of the entire fire alarm system 100, but the on-site technician 108 (or a remote technician 130) could request a report at any time before or during the test.

In the illustrated embodiment, the on-site technician 108 sends a report request to the central operations system 118. The central operations system 118 queries the data storage system 124 to obtain an aggregate history for all of the fire detection and fire annunciation devices of the fire alarm system 100. The aggregate history data are transferred to the mobile computing device 110 and reviewed by the on-site technician 108. The on-site technician 108 may then add annotations to the aggregate history data and send the annotated aggregate history data to central operations system 118.

Additionally, the sequence diagram 900 also illustrates how the system handles an unsolicited or "real" alarm (labeled Unsolicited Alarm). While the illustrated embodiment distinguishes "real" alarms from technician activated alarms, these differences are only for illustrative purposes. In a typical implementation, the control panel 102 does not distinguish between "real" and technician activated alarms.

Upon receiving a "real" alarm signal, the control panel 102 generates event data, which is sent to the testing computer 104. The testing computer 104 sends the event data to the central operations system 118, which records the event data in the data storage system 124 and immediately sends the event data to the mobile computing device 110 of the on-site technician 108.

Upon receiving the event data for the unsolicited alarm, the on-site technician 108 is able to see and identify the unsolicited alarm. In the event that the unsolicited alarm represents a real emergency or threat to life and/or property, i.e., an actual fire, for example, the on-site technician generates an alarm condition command that is sent to the central operations system 118. The central operations system 118 sends an alarm condition command to the testing computer 104, which communicates the command to the control panel 102. The control panel 102 is then able to activate the audio and visual alarms/warnings of the fire annunciation devices to warn the building occupants of the possible emergency.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for testing a fire alarm system, the method comprising:

in response to a technician activating devices of the fire alarm system, the activated devices signaling a control panel;

sending event data from the control panel to a central operations system concerning the activated devices; and sending the event data from the central operations system to a mobile computing device operated by the technician, wherein the event data sent to the mobile computing device includes a detected smoke level or detected temperature from the devices.

2. The method according to claim 1, wherein the central operations system receives event data from different control panels in response to testing different fire alarm systems at different facilities.

3. The method according to claim 2, wherein the received event data from the different control panels of different fire alarms systems are stored in a data storage system of the central operations system.

4. The method according to claim 1, wherein the central operations system sends device history data along with the event data to the mobile computing device operated by the technician.

5. The method according to claim 1, further comprising the technician applying annotations to the received event data, the annotated event data being sent to the central operations system.

6. The method according to claim 1, wherein the event data include a physical address of the activated devices, a date and time of the activation, a fault state of the activated devices, at least one analog value of the activated devices, and/or a custom label of the activated devices.

7. The method according to claim 1, wherein the devices include smoke detectors, carbon monoxide detectors, temperature sensors, pull stations, speakers/horns, bells/chimes, light emitting diode (LED) reader boards, and/or strobes.

8. The method according to claim 1, wherein the central operations system sends an aggregate history of all the devices of the fire alarm system to the mobile computing device in response to a report request from the mobile computing device.

9. The method according to claim 1, further comprising enabling a testing computer, which is connected to the control panel, to silence, acknowledge, and/or reset activated devices when the control panel is in test mode.

10. The method according to claim 1, further comprising two or more technicians activating devices of the fire alarm system and sending the event data from the central operations system to mobile computing devices operated by the technicians.

11. A testing system for a fire alarm system comprising a control panel that receives signals from devices, including signals generated in response to activation of the devices by a technician during a test of the devices, and that generates event data based on the signals, the testing system including:

a central operations system that receives the event data; and a mobile computing device operated by the technician that receives the event data from the central operations system;

wherein the event data sent to the mobile computing device includes a detected smoke level or detected temperature from the devices.

12. The system according to claim 11, wherein the central operations system receives event data from different control panels in response to testing different fire alarms systems at different facilities.

13. The system according to claim 12, wherein the received event data from the different control panels of different fire alarms systems are stored in a data storage system of the central operations system.

14. The system according to claim 11, wherein the central operations system sends device history data along with the event data that are sent to the mobile computing device operated by the technician.

15. The system according to claim 11, wherein the technician applies annotations to the received event data, the annotated event data being sent to the central operations system.

16. The system according to claim 11, wherein the event data include a physical address of the activated devices, a date and time of the activation, a fault state of the activated devices, at least one analog value of the activated devices, and/or a custom label of the activated devices.

17. The system according to claim 11, wherein the devices include smoke detectors, carbon monoxide detectors, temperature sensors, pull stations, speakers/horns, bells/chimes, light emitting diode (LED) reader boards, and/or strobes.

18. The system according to claim 11, wherein the central operations system sends an aggregate history of all the devices of the fire alarm system to the mobile computing device in response to a report request from the mobile computing device.

19. The system according to claim 11, further comprising a testing computer that is connected to the control panel, the testing computer being able to silence, acknowledge, and/or reset activated devices when the control panel is in test mode.

20. The system according to claim 11, further comprising two or more technicians simultaneously activating the devices during the test of the devices.

21. A testing system for a fire alarm system comprising a control panel that receives signals from devices, including signals generated in response to activation of the devices by a technician during a test of the devices, and that generates event data based on the signals, the testing system including:

a central operations system that receives the event data; and a mobile computing device operated by the technician that displays a user interface that displays a map that indicates a location of the control panel on the map.

22. A method for facilitating testing a fire alarm system, the method comprising:

a mobile computing device operated by the technician displaying a user interface that displays a map; and the mobile computing device indicating a location of a control panel of the fire alarm system on the map.

23. A method for testing a fire alarm system, the method comprising:

sending event data for a device from a control panel of the fire alarm system to a central operations system concerning the device;

sending event data, received from the control panel, from the central operations system to a mobile computing device operated by the technician; and sending device history information for the device to the mobile computing device.

24. A method for testing a fire alarm system, the method comprising:

sending event data for a device from a control panel of the fire alarm system to a central operations system concerning the device;

sending event data, received from the control panel, from the central operations system to a mobile computing device operated by the technician; and sending device annotation history information for the device from the mobile computing device to the central operations system.

25. The method according to claim 1, wherein the event data sent to the mobile computing device includes current analog values from the devices.

26. The system according to claim 11, wherein the event data sent to the mobile computing device includes current analog values from the devices.

27. A method according to claim 1, further comprising the mobile computing device displays a user interface that displays a map that indicates a location of the control panel on the map.

28. The system according to claim 11, wherein the mobile computing device displays a user interface that displays a map that indicates a location of the control panel on the map.

* * * * *